US005339910A

United States Patent [19]

Mueller

[11] Patent Number: 5,339,910

[45] Date of Patent: Aug. 23, 1994

[54] DRILLING TORSIONAL FRICTION REDUCER

[75] Inventor: Mark D. Mueller, Bakersfield, Calif.

[73] Assignee: Union Oil Company of California, Los Angeles, Calif.

[21] Appl. No.: 47,228

[22] Filed: Apr. 14, 1993

[51] Int. Cl.[5] ..... E21B 10/46

[52] U.S. Cl. ..... 175/61; 175/325.3; 175/408

[58] Field of Search ..... 175/61, 62, 371, 372, 175/408, 325.3, 325.4

[56] References Cited

U.S. PATENT DOCUMENTS 4,220,213 9/1980 Hamilton ..... 175/325.4 X
4,226,291 10/1980 Spelts ..... 175/325.3
5,109,935 5/1992 Hawke ..... 175/408 X
5,190,379 3/1993 White ..... 175/325.3 X

*Primary Examiner*—William P. Neuder
*Attorney, Agent, or Firm*—Gregory F. Wirzbicki; William O. Jacobson

[57] ABSTRACT

Rotary drag during drilling is reduced by 1) adding roller bearings to a tubular string and drill bit, and/or 2) adding a bearing assembly to the tubular string, and/or 3) adding a rotary discoupling tool to the tubular string. At the drill bit, this is achieved by miniature rollers built into the gauge section. Along the drill string periodic roller bearings or bearing standoff assemblies are placed along the string length and/or a rotary discoupling tool capable of sealing fluid and transmitting compression and tensile loads is placed in the string. The combination minimizes bit whirl and rotational drag, especially during the drilling of extended reach wellbores.

20 Claims, 4 Drawing Sheets

FIG. 4.
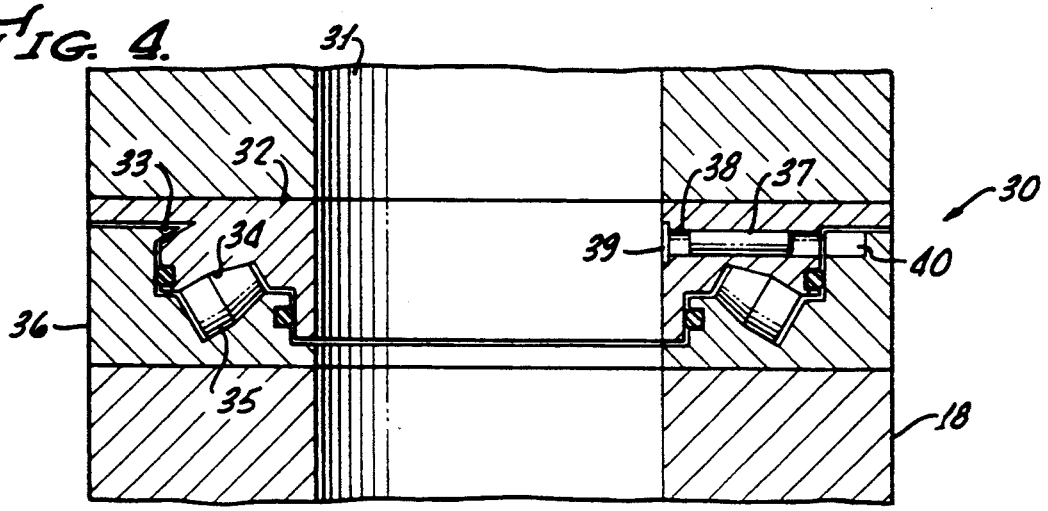
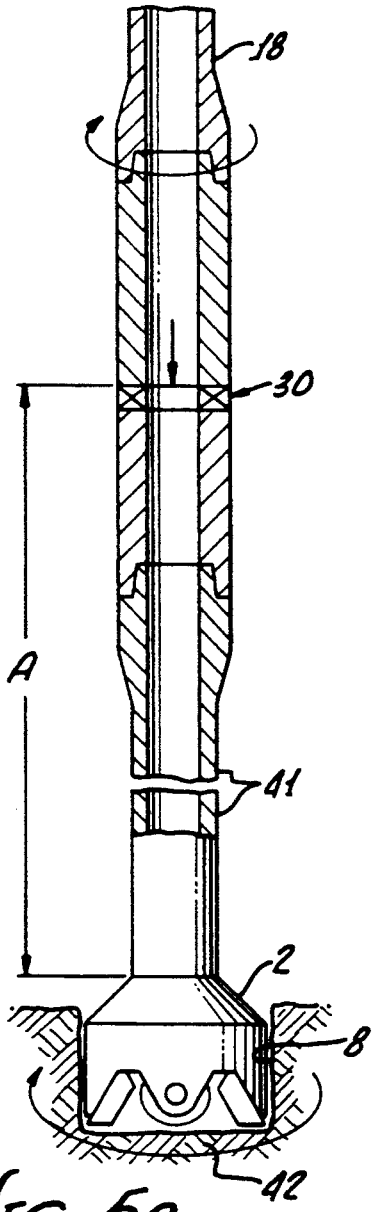
FIG. 5a.
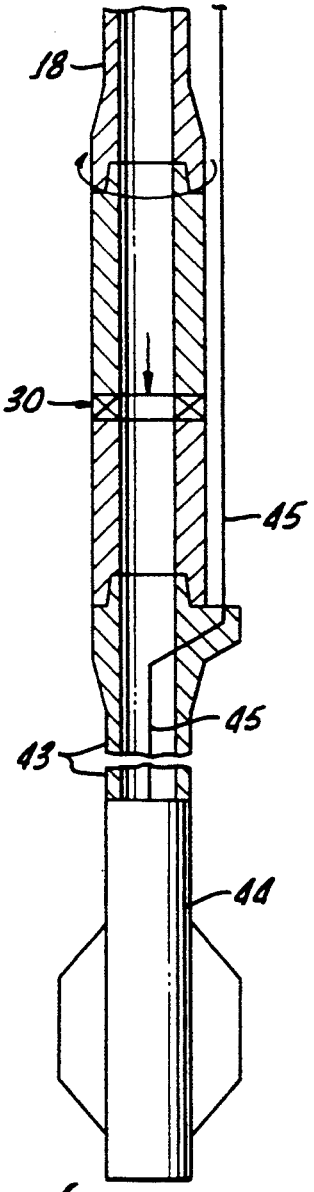
FIG. 5b.

DRILLING TORSIONAL FRICTION REDUCER

This invention relates to well drilling devices and processes. More specifically, the invention relates to an apparatus and method of reducing torsional friction during rotary drilling and completion of a well.

BACKGROUND ART

Oil, gas and other types of wells are typically excavated and completed using rotary drilling technology. For example in a near-vertical wellbore, drilling is typically accomplished by a rotary drill bit hung on a drill string which is rotated from a surface mounted rotary table or other means for inducing rotary motion.

In near-vertical wells, the rotary drag due to frictional contact between the drill string (excluding the drill bit) and the wellbore is typically not large when compared to the rotary forces at the drilling face. Rotary wellbore drag of the drill string is therefore easily overcome by the rotary means typically associated with rotary drilling a near-vertical wellbore.

However, rotary drag at the drill bit can cause significant problems in near-vertical wells and drill bit and drill string problems in extended reach wells. A major problem affecting the life and performance of drag-type drill bits, e.g., PDC drill bits, is "bit whirl," the tendency of a drill bit to wobble off-center while rotating. Bit whirl is due, at least in part, to unequal rotary drag forces acting on the bit's outside diameter or gauge pads. Even a small amount of bit wobble can lead to an unequal distribution of forces on the cutters, causing premature failure or accelerated wear of one or more cutters and drill string damage. Conventional corrective measures, such as using low friction gauge materials and/or other bit gauge modifications, have not eliminated this problem even in near-vertical wells.

Rotary drag-caused drilling and completion problems become much more pronounced for wells at deviated angles from the vertical, especially extended reach wells. In addition to the potential for bit whirl problems at the drill bit, the rotary frictional drag generated by the drill string becomes very significant, especially when using heavy weight drill strings in nearly horizonal wellbores. As the wellbore extends further out, the rotary drag on the drill string (or other tubulars in the well) may even preclude rotation, e.g., the rotary force required to overcome the torsional drag exceeds the torsional strength of the drill string causing (twist-off) failure. Since the diameter and weight of a casing/-liner string being set is typically larger and heavier than a drill string, the torsional forces needed to rotate the casing or liner can be even greater than that required to rotate a drill string and/or greater than the available rotary torque.

Common drilling and completion methods for overcoming tubular rotary drag either 1) use conventional drill pipe rubbers, or 2) reduce the sliding frictional forces along the string, e.g., by lubrication. In the first method, pipe centralizers, standoffs or other means for minimizing pipe/wellbore contact area are attached along the length of the drill string. But for nearly horizontal wellbores, the increased forces at the centralizers or other small contact area devices have the potential for damaging the wellbore and increasing axial drag when the tubulars are slid into the wellbore. This damage potential has generally precluded application of this drag reducing method to typical extended reach wells.

Other frictional reducing methods lubricate or otherwise reduce the coefficient of friction. These lubricating methods are limited in effectiveness since the coefficient of friction cannot be reduced to zero. Other frictional reducing methods include flotation methods and devices such as described in U.S. Pat. Nos. 4,986,361; 5,117,915; and 5,181,571, which are herein incorporated by reference. These prior methods do allow longer deviated boreholes, but as longer deviated boreholes are needed, unacceptable drag problems may still be generated.

SUMMARY OF THE INVENTION

Such rotary drag problems are avoided in the present invention by using roller sleeves at pipe joints to increase the amount of rotating drill pipe contact area and/or using a discoupling device to avoid rotation (and resulting rotary drag) of a portion of the drill string, and/or reaming and compacting the wellbore using rollers at the drill bit gauge area to support greater loads and provide a rolling rotary contact to prevent wellbore damage. The present invention goes beyond conventional friction reduction methods by 1) providing rolling contact and reaming and/or compacting capability at drill bit-to-wellbore peripheral contact areas, 2) providing a weight bearing as well as friction reducing capability at concentrated pipe string-to-wellbore contact areas, and/or 3) avoiding unnecessary string rotation.

This reduction in rotary drag is achieved in one embodiment by 1) adding miniature roller-compactors built into the gauge section of a drill bit, 2) adding sleeved roller bearings to the string, and/or 3) adding a rotary discoupling tool. The combination of sleeved roller bearings at periodic intervals and/or standoff assemblies along the string length, a rotary discoupling tool capable of sealing fluid and transmitting compression and tensile loads, and drill bit roller-compactors significantly reduces drag related problems, especially for extended reach applications.

BRIEF DESCRIPTION OF THE DRAWINGS

FIG. 4 shows a cross-sectional side view of a rotary discoupling tool;

FIGS. 5*a* and 5*b* show side views of discoupling assemblies;

In these Figures, it is to be understood that like reference numerals refer to like elements or features.

DETAILED DESCRIPTION OF THE INVENTION

Figure 1:
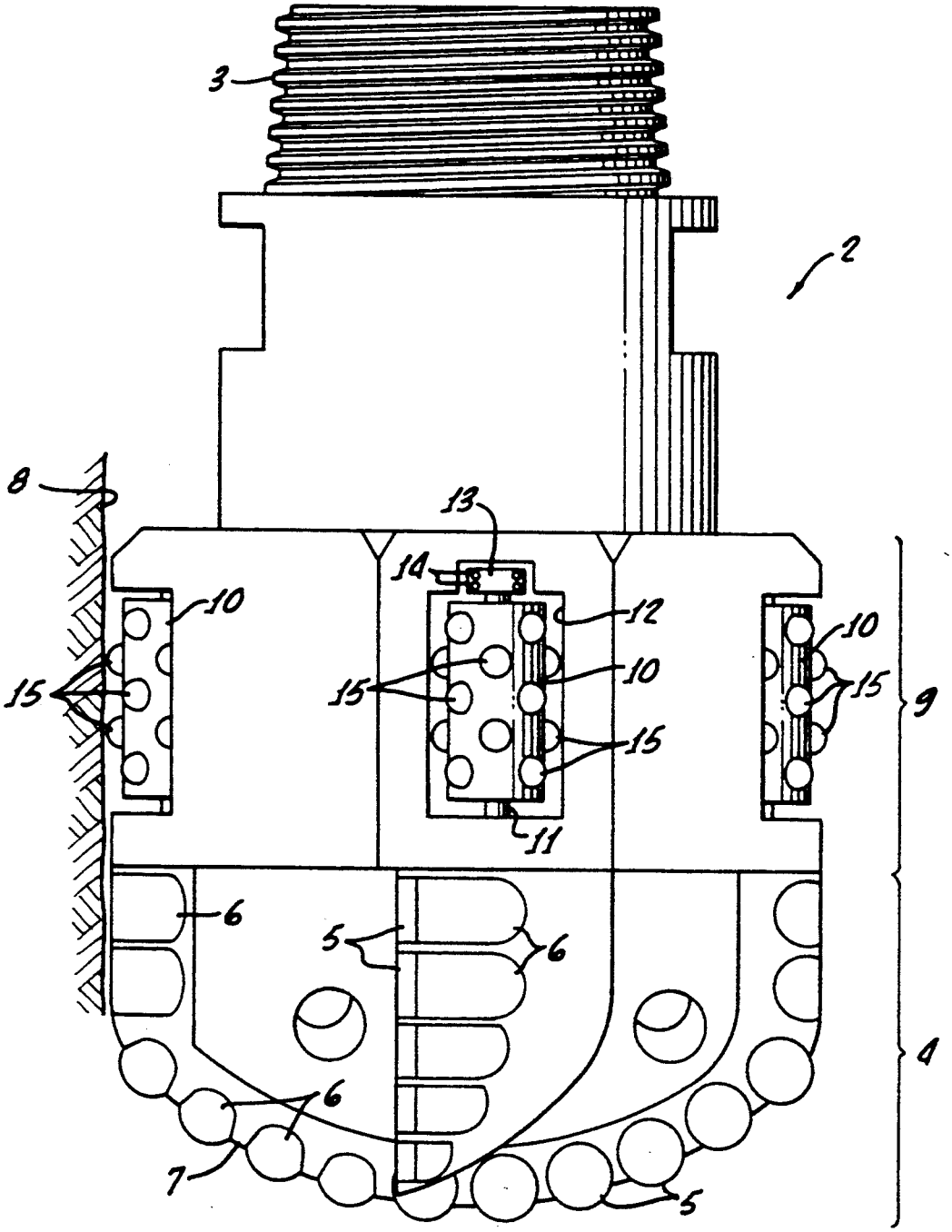
FIG. 1 shows a side view of a rotary drill bit.

FIG. 1 shows a schematic side view of a PDC-type rotary drill bit 2 which embodies the invention. The drill bit 2 includes male threads on a drill body 3 to attach to tubulars (see FIG. 2) or a drill collar (not shown). Several cutting structures 4 are attached to the drill body 3 and the structures 4 are composed of cutting faces 5 supported on protrusions 6 embedded on rotatable structures 7. Each of the rotatable structures 7 rotate around axes that are approximately orthogonal to the drilling direction, i.e., the axis of the drill bit. The face of the formation being drilled (see FIG. 5) would be contacting and below the cutting structure 4 in the near-vertical orientation shown in FIG. 1. However, the drill bit 2 and cutting faces 5 would be in a different orientation when drilling an extended reach wellbore, e.g., rotated 90 degrees. A flow of drilling mud or other fluids may also be provided to assist in cooling, purging, and removing cuttings during drilling.

A portion of the wellbore 8 is shown proximate to a gauge surface or area 9 of the drill bit 2 in FIG. 1. The gauge surface 9 is sized to roughly approximate the same outside diameter as cut by the cutting structure 4 when rotated. Embedded into the outside diameter gauge surface 9 of the bit 2 are a plurality of roller-drums or roller-compactors 10 rotatively supported by shafts 11. The roller-compactors 10 radially protrude beyond the gauge surface 9.

In the embodiment shown, four roller-compactors 10 are used, three of which are at least partially visible in the side view shown. The hidden part of one partially visible roller-compactor 10 is shown dotted for clarity. The roller-compactors 10 are placed in recessed cavities 12, and the shaft 11 is held in place by a lock down block 13. Each lock down block 13 is secured within the recessed cavity 12 by screws 14.

The roller-compactors 10 rotate on shafts 11 which are substantially parallel to the bit axis centerline (℄). On the outside surface of the roller-compactors 10 are projections 15, typically hardened, which serve multiple purposes. The roller-compactors 10 and projections 15 provide radial support and reduce rotating friction, but can also compress and ream out the wellbore 8 during rotary drilling.

A first purpose achieved by the roller mounted projections 15 and roller-compactors 10 is weight bearing. The weight of the bit 2 must be at least partially supported by the wellbore 8 in a highly deviated wellbore. Instead of bit pads slidably contacting the wellbore 8, the roller-compactors 10 (and roller mounted projections 15) form a dimpled surface which provides a variable and rolling bearing contact area. In a near vertical wellbore, contact is primarily between the projections 15 and the wellbore 8. As more bit weight (or other radial forces) is supported, e.g., as the rotating bit traverses into a more highly deviated wellbore portion, the roller-compactors 10 and rolling projections 15 are further pressed into the wellbore wall, tending to increase contact area and control increase stresses while reducing rotary drag.

A second purpose is to compact and ream the wellbore to a specific diameter. The extended roller 10 length, roller and projection mounting position at the outermost radial position beyond the gauge surface 9, and the shape of the projections 15 increase the probability of compacting and/or removing loose formation materials remaining from the wellbore (at a specified diameter) after being excavated by the cutting structure 4. The same roller/projection shape and dimensions, extended length, and roller mounting minimize the probability of tearing off or otherwise damaging formation material outside the specified diameter. The roller mounted projections 15 also minimize prolonged sliding contact and axial drag during drilling penetration. The low-drag roller-compactors 10 (and projections 15) and smoother contacting of the wellbore 8 help to control bit whirl. The reaming and wellbore compacting also allow the wellbore to support increased stresses without damage.

The number of roller-compactors 10 attached to or near the gauge section 9 of drill bit 2 depends upon a number of factors such as wellbore diameter and is theoretically unlimited, but practical considerations typically limit the number of rollers 10 to less than eight. For a rotary bit cutting a nominal 8½ inch (21.59 cm) diameter wellbore, the number of rollers or roller-compactors typically ranges from two to six, more typically ranging from three to four. The size of each roller-compactor is similarly practically, but not theoretically limited. The diameter of each roller-compactor typically ranges from ¼ to 2 inches (0.635 to 5.08 cm), more typically ranging from ½ to 1 inch (1.27 to 2.54 cm) for a nominal 8½ inch (21.59 cm) wellbore. The length of each roller-compactor typically ranges from 1 to 6 inches (2.54 to 15.24 cm), more typically ranging from 2 to 4 inches (5.08 to 10.16 cm) for a drill bit cutting a nominal 8½ inch (21.59 cm) wellbore.

Although the axis of rotation for the rollers 10 and the drill bit are substantially parallel, they are not co-linear. The axes of rotation of the cutters is roughly orthogonal to the roller or drill bit axis of rotation.

The drill bit rotation of the outermost portions of the roller-compactors 10 forms a roller gauge diameter, and the outermost (bit rotated) projections form a projection gauge diameter, both of which are different from the outermost diameter cut by the cutters. Again, practical, not theoretical, considerations typically limit the roller gauge and projection gauge diameters to typically less than 0.01 inch (0.0254 cm) larger than the outermost cut diameter, but at least 0.001 inch (0.00254 cm) larger than the cut diameter. For example, i.e., for an outermost cut diameter of 8½ inch (21.59 cm) plus or minus a 0.01 inch (0.0254 cm) tolerance, an outermost roller gauge diameter (including projections) typically ranges from about 8.5 to 8.511 inch (21.59 to 21.6179 cm). This range typically assures a minimum compaction and/or reaming of the wellbore will be accomplished by the roller-compactors or roller-reamers 10, especially as the cutters wear to produce smaller cut diameters.

The shape and size of the projections 15 are similarly practically, but not theoretically limited, including the lack of any projections on any roller. When projections 15 are included, each projection is typically a spherical segment projecting beyond the roller diameter no more than 40 percent of its diameter, more typically projecting no more than 30 percent of its diameter. Alternative projection shapes include parabaloid segments, truncated cones, and irregular shaped natural diamonds imbedded in the roller-reamers 10.

The amount of reaming and/or compacting of the wellbore 8 by the roller projections 15 are again theoretically unlimited, but practically limited. Reaming and/or compacting typically increases the diameter (over the cut diameter) by no more than ¼ inch (0.635 cm), more typically less than 0.1 inch (0.254 cm). The amount of reaming and/or compacting results in an increased radially compressive stress the wellbore can withstand without significantly increasing drilling time or cost for many types of porous formations.

Similar to size variations, roller and projection materials of construction can vary depending upon formation properties and other drilling variables, but contact area materials are expected to be hard relative to typical structural materials such as steel. Tungsten carbide and diamond are example of relatively hard materials of construction which may be used for contacting projection areas or as a protective coating over less hard projection materials of construction.

In addition to improving wellbore bearing strength by compacting and/or reaming the wellbore, the roller-compactors 10 may also provide better bit gauge protection. Damage to the gauge area 9 of a drill bit 2 can accentuate bit whirl problems. The better protection of the gauge area 9 further minimizes these bit whirl problems and adds to the life of the bit.

Figure 2:
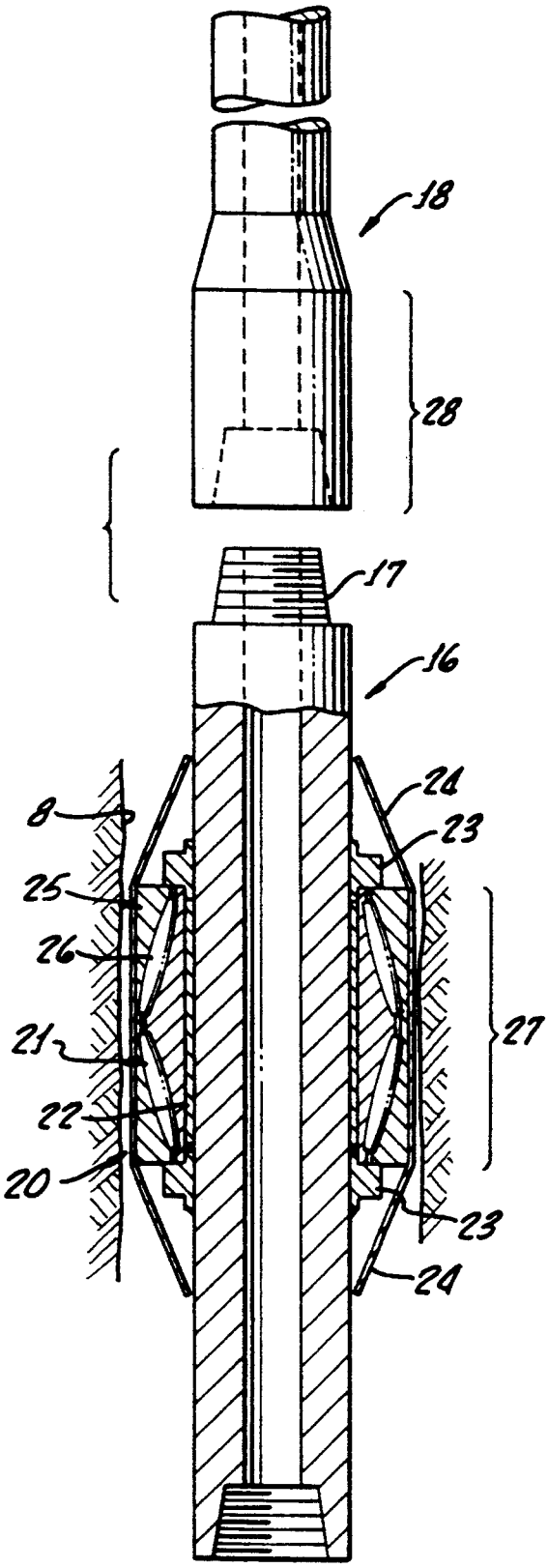
FIG. 2 shows a cross-sectional side view of a drill string standoff assembly.

FIG. 2 shows a cross-sectional side view of a rotating drill pipe torsional bearing and friction reducer mounted on the outside diameter of a pup (or short length) joint 16. The external threads 17 of the pup joint 16 mate with a drill pipe or string portions 18 (mating threads shown dotted) and the internal threads 19 of the pup joint 16 mate with another pipe string portion (not shown). The outside diameter of a pup joint is typically larger than the outside diameter of the string portions 18, but significantly less than the inside diameter of the wellbore 8.

The bearing assembly 20 is attached to the pup joint 16 to provide a standoff, low-friction rotating bearing contact surface with the wellbore 8 (only a portion of which is shown for clarity). The bearing assembly 20 comprises a thrust bearing race assembly 21, compression packing 22, end stops 23, and sleeve 24. The diameter of the sleeve 24 is nominally sized to be ¼ inch (0.635 cm) larger than the tool joint diameter, but may range from about ⅛ to ¾ inch (0.3175 to 1.905 cm) larger than the joint diameter.

Figure 3:
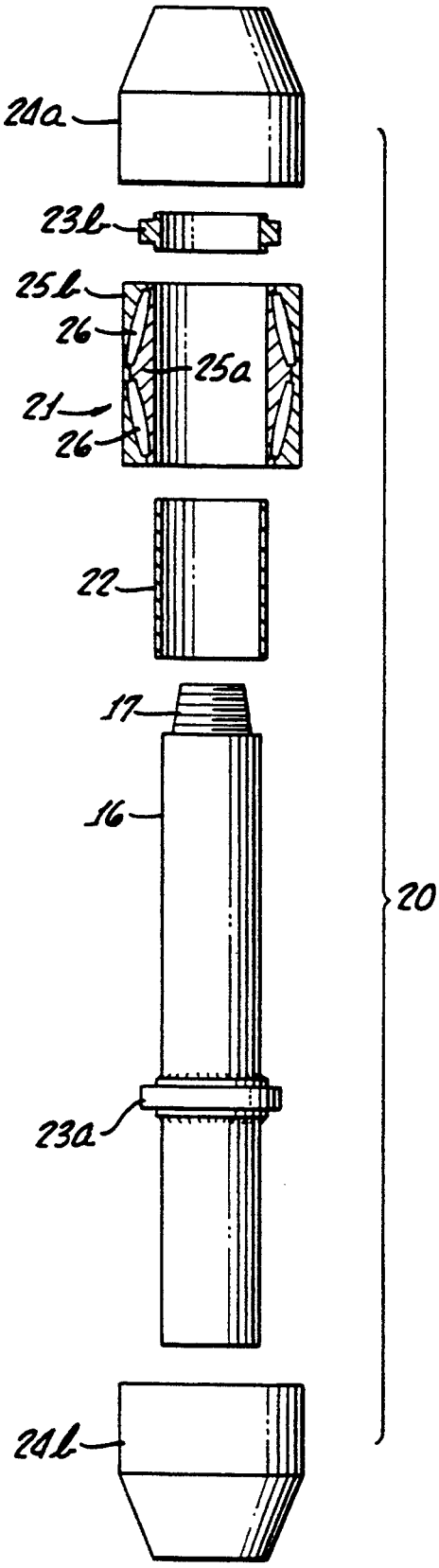
FIG. 3 shows an exploded side view of a bearing assembly.

FIG. 3 shows an exploded side view of the bearing assembly 20. One stop, 23*a*, is shown welded onto pup joint 16 while the other stop, 23*b*, is shown exploded from the pup joint 16. When the pup joint is joined to other pipe sections, it becomes part of the tubular string. The compression packing 22 is typically composed of woven fibers imbedded in a binder and secures the bearing race assembly 21 to the pup joint 16. The bearing race assembly 21 is shown in cross-section, comprising a two piece race (25*a* and 25*b*) and thrust bearings 26. The two pieces of the sleeve, 24*a* and 24*b*, are joined and attached to the outer portion of the two piece race 25*b*. This allows the protective sleeve pieces 24*a* & 24*b* to rotate with respect to the pup joint 16.

The protective sleeve pieces 24*a* & 24*b* of the bearing race assembly 20 are joined to form a protective shell preventing intrusion of cuttings or other unwanted materials into the bearing race assembly 20. An alternative configuration could provide a separate (lubricating) stream of fluids to purge the roller bearing area of cuttings in conjunction with or in the absence of a sleeve.

The outside diameter of the sleeve pieces 24*a* & 24*b* is sized to provide a larger wellbore bearing contact area than the drill string diameter, i.e., a larger arc or pie-shaped bearing zone, but not so large so as to restrict the flow of cuttings and drilling mud within the wellbore. For a 5 inch (12.7 cm) nominal diameter drill string having a 6⅜ inch (16.1925 cm) nominal joint diameter in a 8½ inch (21.59 cm) wellbore, the outside diameter of the sleeve pieces 24*a* & 24*b* can typically range from about 6.5 to 7 inches (16.51 to 17.78 cm), more typically no larger than 6.75 inches (17.145 cm). In other drilling applications, the outside diameter of the sleeve is typically no more than about ¾ inch (1.905 cm) larger than the maximum drill string (joint) diameter.

The nominal contact area 27 shown in FIG. 2 between the sleeve 24 and the wellbore 8 is shaped and dimensioned to carry significant radial (perpendicular to the shown in FIG. 3) loads in the arc segment which forms the wellbore contact area. For a nominal 8½ inch (21.59 cm ) wellbore diameter, the contact area 27 is typically increased by at least 12 percent (as a function of the difference between the square of the joint and sleeve diameters), but the bearing area may be further increased by extending the length of the sleeve.

The roller bearing pup joints can be used at each joint or stand of pipe in the drill string, but more typically are periodically placed at each stand of drill pipe (which may be composed of from one to three joints). In addition to reducing friction and providing a larger rotating bearing surface to reduce wellbore damage during drilling, the periodic bearing assembly and pup joints provide an extended "fishing" neck 29 to mate with overshot tools, e.g., to retrieve struck portions of the tubular string. The minimum length of the fishing neck (beyond the bearing assembly) is typically 12 inch (30.48 cm) for a nominal 5 inch (12.7 cm) diameter drill pipe, but the minimum length of the fishing neck can typically range from 8 to 18 inches (20.32 to 45.72 cm).

The rotating and enlarged contact area at the pup joints also minimizes damage to the interior surface of any casing that the drill string must traverse during drilling. Casing wear can be a significant constraint or cost item during conventional drilling operations. Other advantages of pup joint mounted bearing assemblies are minimized drill string wear and damage, reduced need for high (torsional) strength drill strings and connections, and increased extended reach capabilities.

FIG. 4 shows a cross-sectional view of a discoupling and bearing assembly 30 attached to drill string 18. Although most of the drill string is typically in tension during the drilling of near-vertical wellbores, a significant portion of the drill string may be in axial compression during the drilling of extended reach wells when required to maintain an adequate axial bit loading. The discoupling and bearing assembly 30 allows compressive loads to be axially transmitted to the drill bit without rotating the drill string, e.g., a mud motor can rotate a short drill pipe section and/or a rotary drill bit attached to a (discoupled) non-rotating drill string. The discoupling and bearing assembly 30 is shown attached between drill string portions (only one portion 18 shown for clarity), but may also be attached between the drill bit and a drill string portion. If a tubular bore 31 is substantially equal in diameter to the inside diameter of the attached drill string portions, the bore 31 is capable of unimpeded fluid flow from one drill string portion to another.

The upper bearing portion 32 of the discoupling and bearing assembly 30 comprises a tension load support surface 33 and an upper thrust bearing surface 34 for compression loads. The upper bearing portion 32 contacts thrust bearings 35 which rotatively contact the lower thrust bearing race portion 36. When the assembly 30 is under compressive loading, the thrust bearings effectively discouple rotation of the upper portion with little drag on the lower portion of the assembly 30.

The discoupling assembly 30 is capable of transmitting a substantial compressive load when discoupling rotation of the drill string. For a 5 inch (12.7 cm) nominal drill string diameter a typical compressive load of at least 50,000 pounds (222, 400 newtons) can be sustained without damage, more typically a compressive load of 75,000 pounds (333, 600 newtons) can be sustained.

The overhanging tension support surface 33 also allows tensile forces to be carried by the assembly. In the configuration shown, the tensile support surface 33 and contacting surfaces allow sliding contact. The tensile axial load sliding also discouples rotation of the upper portion from the lower portion, but not with the low friction obtainable by the thrust bearings when the assembly is in axial compression. In an alternative embodiment, the tensile contacting surfaces include thrust bearings similar to the compressive thrust bearings shown, reducing drag when discoupling under tensile loading. In another alternative embodiment, the tensile contacting surfaces can be ribbed or otherwise engaged so that the upper portion is not discoupled under tensile loads but discoupled when under compressive loads.

The discoupling assembly 30 is also capable of transmitting a substantial tensile load when either discoupling rotation or coupling rotation of the drill string. For a 5 inch (12.7 cm) nominal drill string diameter, a typical tensile load of at least 200,000 pounds (889, 600 newtons) can be sustained without damage, more typically a tensile load of 300,000 pounds (1,334,400 newtons) or as much tensile load as the drill string can be sustained.

An optional dog or pin 37 for pressure actuated coupling after discoupling is shown in a passageway 38. In the optional embodiment shown, the passageway 38 of the assembly 30 is sealed by a rupture disc 39 until a sufficient pressure is applied to the tubular bore 31. When the passageway 38 is open to the fluid pressure, the pressure displaces the pin 37 towards cavity 40 in the lower bearing or race portion 36. When the pin 37 engages cavity 40, the string portions are coupled, i.e., the assembly no longer discouples rotation.

The optional pressure actuated coupling may also be combined with pressure actuated or assisted running of tubulars as disclosed in U.S. Pat. No. 5,205,365 which is herein incorporated by reference. For example, telescoping tubular sections (shown in U.S. Pat. No. 5,205,365) can be pressure-assisted run into a deviated well while a portion of the tubulars is rotatively discoupled and another portion is rotated. When the tubulars reach a desired location (at a calculatable pressure), the pressure actuated coupling actuates and discoupling is ended.

FIGS. 5*a* and 5*b* shows side views of two other applications of the discoupling assembly 30, one attached to a drill bit 2 and another attached to a logging string 41. The first application shown in FIG. 5*a* attaches and locates the discoupling assembly 30 on a drill string a distance "A" from a drill bit 2. A mud motor may be located at the bottom of the lower (rotating) portion of the drill string, providing a means for rotating the drill bit 2 (and lower string portion). The distance "A" would be long enough (e.g., as determined by torque and drag analysis) so that the axial weight of the rotating portion would overcome axial drag of the lower section and allow the rotating portion to slide into the wellbore, but not so long so as to create excessive rotary drag when rotated. The lower non-rotating portion of the drill string 18 can generate enough torsional drag to overcome the reactive torque created by the rotating bit cutting the drilling face 42 of the wellbore 8.

The second application shown in FIG. 5*b* attaches a discoupling assembly 30 above an umbilical line side entry sub 43 in a drill pipe conveyed logging string 44. The discoupling assembly 30 allows the upper drill string portion to be rotated (e.g., to reduce axial drag) and umbilical line 45 to enters a non-rotating (lower) portion of the drill string. The upper portion rotation (and reduced axial drag) helps to "push" or slide the logging tools and string towards the bottom of the wellbore (not shown). The non-rotation of the lower portion of the logging string 44 also helps to prevent damage to logging tools (not shown) attached to the logging string.

Figure 6B:
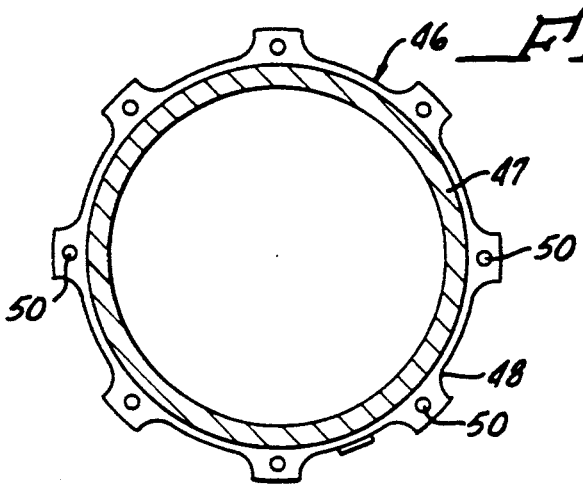
FIGS. 6*a* and 6*b* show side and end views of an alternative standoff assembly.
Figure 6A:
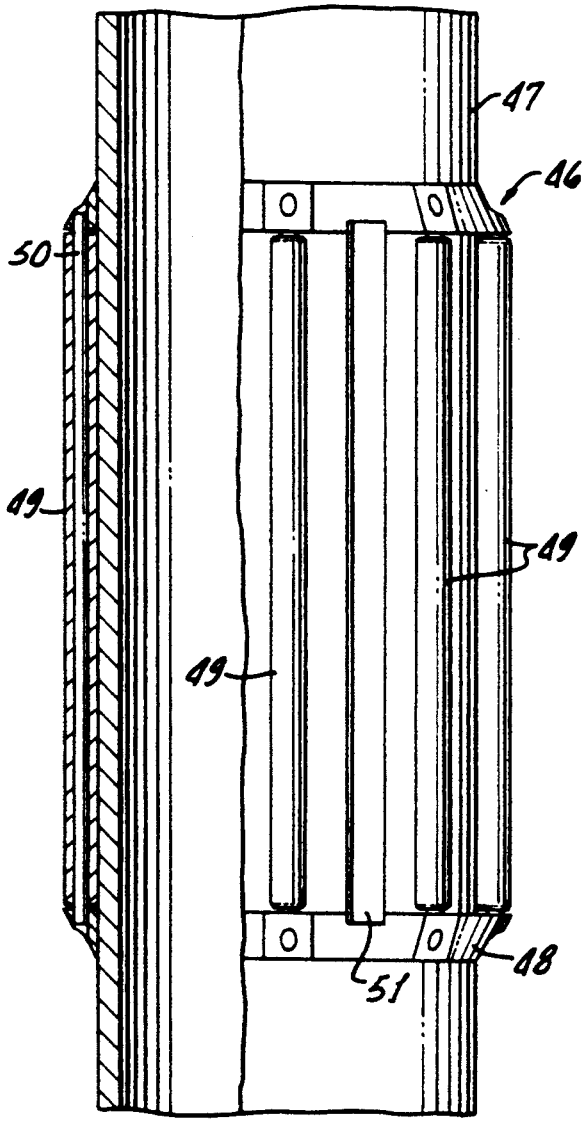

FIGS. 6*a* and 6*b* show side and end views of an alternative drag reducing standoff 46 for application to tubulars such as a liner 47. The standoff 46 comprises end rings 48, rollers 49, bolts 50 through the rollers 49 attached to end rings 48, and a brace 51. The bolts also serve as shafts upon which rollers 49 rotate. The brace, typically at least two braces, prevent the end rings from cocking and obstructing the rotation of the rollers.

Standoffs 46 could be placed at each connection of the liner 47 or other tubular being run into a wellbore (not shown). Connection locations tend to be contacting and high drag areas and locating standoffs at the connection locations significantly reduces torsional drag even though the wellbore may contact other portions of the tubulars 47. A typical torsional drag reduction of at least 25 percent using the standoffs 46 at these locations is expected and the reduction in torsional drag may be as high as a 50 percent reduction or more.

Figure 7:
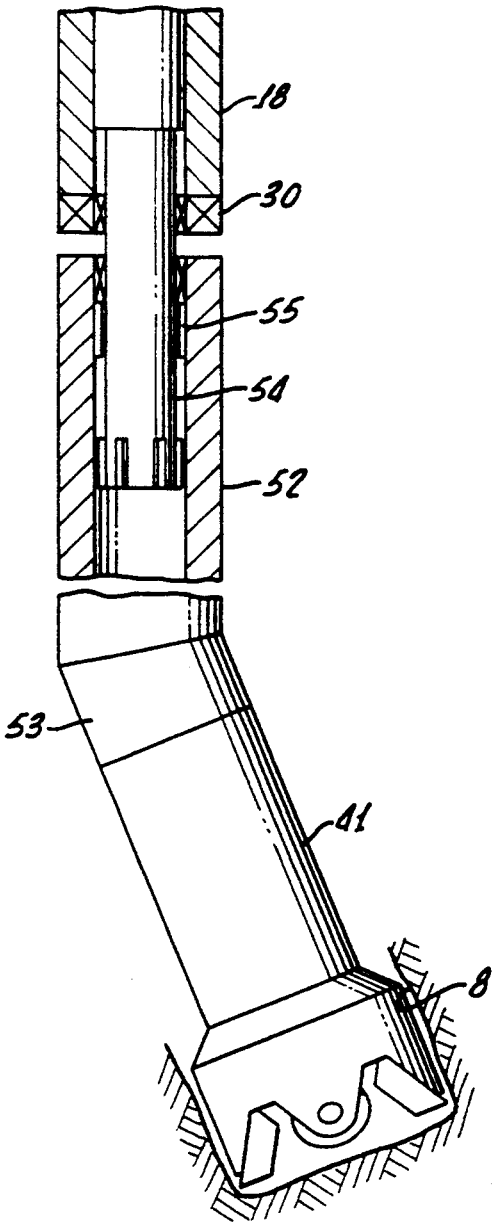
FIG. 7 shows a side view of an orienting drill string assembly.

FIG. 7 is a side view of a string comprising tubulars 18, discoupling assembly 30, splining assembly 52, orienting sub 53, mud motor 41 and drill bit 8. The discoupling assembly 30 uses splined stab 54 to slidably attach the assembly 30 to splining assembly 52. When the assembly 30 was under compressive loads, the rotation of the upper tubulars 30 is discoupled from the lower portions. When tensile loads are applied, the splined stab 54 slides upward until splines 55 engage the mating portion of the splined stab 54. Because of the orienting sub 53, the direction of the drilling bit would be fixed with respect to the centerline of the orienting subassembly 53. If this direction was not desired, tensile loads could be reapplied, the splines engaged and the bit reoriented.

Still other alternative embodiments are possible. These include: a plurality of roller-drums or roller-compactors on a plurality of drill collars, spring loaded rollers mounted on shafts allowing rolling and axial displacement when contacting the wellbore and a return to the original axial location when not in rolling contact with the wellbore, fluid purging of the drill bit roller-reamers, and including roller projections similar to projections 15 on drill string standoffs.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An apparatus for drilling a wellbore extending from near a surface location to an underground drilling face which comprises:

a tubular string extending from a first end near said surface location to a second end near said drilling face when said tubular string is inserted into said wellbore;

a drill bit attached to said tubing string proximate to said second end and having rotatable cutters and a drill bit axis substantially perpendicular to said drilling face, said drill bit capable of removing materials from said drilling face when rotatably contacting said drilling face;

a plurality of rollers attached to the periphery of said drill bit and each rotatable around a roller axis substantially parallel to said drill bit axis, said rollers capable of rotating separately from said rotating cutters and bearing forces between said wellbore and said drill bit, wherein said forces are transmitted substantially perpendicular to said drill bit axis when said drill bit is rotating, wherein said separately rotatable cutters produce a cut wellbore diameter and said rollers compact said formation to increase said cut wellbore diameter to a larger compacted diameter by not more than about 0.021 inches larger when said apparatus is drilling said wellbore;

a first roller bearing assembly attached to the periphery of said tubular string; and a second roller bearing assembly attached to the periphery of said tubular string and spaced apart from said first roller bearing assembly, wherein said tubular string also comprises:

a first tubular string portion extending downward from said first end when located within said wellbore;

a second tubular string portion extending upward from said second end when located within said wellbore; and a thrust bearing-like assembly connecting said first and second tubular string portions.

2. The apparatus of claim 1 wherein said thrust bearing-like assembly also comprises:

a first element attached to said first tubular string portion and capable of transmitting substantial compressive loads;

a second element attached to said second tubular string portion and capable of rotating relative to said first element and transmitting said substantial compressive loads;

a passage within said first and second elements for conducting fluid between said first and second tubular string portions; and a seal for restricting the fluid to within said passage when said second element is rotating with respect to said first element.

3. An apparatus for excavating a cavity having a wall which has a representative width dimension and a length extending from near a surface location to an underground face which comprises:

a tubular string having an outside diameter and extending along a tubular string axis from a first end near said surface location to a second end near said face when inserted into said cavity;

a first standoff comprising a plurality of rollers attached to said tubular string at a first location along said length near the outside diameter and each rotatable around a roller axis substantially parallel to said tubular string axis, at least two of said rollers radially located to form an outermost diameter when said string is rotated, said outermost diameter being substantially greater than said outside diameter and substantially less than said representative dimension, wherein said rollers are capable of bearing forces between said cavity wall and said tubular string and said forces are transmitted substantially perpendicular to said string axis when said tubular string is rotating; and a second standoff comprising a plurality of rollers attached to said tubular string at a second location along said length which is spaced apart from said first location.

4. The apparatus of claim 3 which also comprises a drill bit attached to near an end of said tubular string proximate to said underground face when said tubular string is inserted into said cavity.

5. The apparatus of claim 4 wherein said drill bit comprises:

a drill body having a radial periphery;

rotatable cutting elements attached to said drill bit; and separately rotatable roller elements attached to the radial periphery of said drill body.

6. The apparatus of claim 5 wherein said tubular string comprises:

a first and second drill pipe sections; and a joint section attaching an end of said first drill pipe section to an end of said second drill pipe section.

7. The apparatus of claim 6 wherein said tubular string also comprises a thrust bearing assembly attached to said first drill pipe section.

8. The apparatus of claim 7 wherein said thrust bearing assembly also comprises:

a first element attached to said first drill pipe section and capable of transmitting substantial compressive loads;

a second element attached to another pipe joint section and capable of rotating relative to said first element and transmitting said substantial compressive loads;

a passage within said first and second elements for conducting fluid; and a seal for restricting the fluid within said passage when said second element is rotating with respect to said first element.

9. A discoupling apparatus for discoupling rotation from a first portion of a drilling string to a second portion of a drilling string when said drilling string is within a wellbore and extends from near a surface location to near an underground drilling face, said discoupling apparatus comprising:

a first element attached to said first portion and capable of transmitting a substantial compressive load;

a second element attached to said second portion and capable of rotating relative to said first element and transmitting said substantial compressive load;

a passageway for conducting fluid between said first and second elements;

a seal for restricting the fluid within said passage when said second element is rotating with respect to said first element; and means for coupling and discoupling rotation of said first element from said second element.

10. The apparatus of claim 9 wherein said means for coupling and discoupling comprises a splined stab attached to said first element and slidably engagable to a mating spline attached to said second element.

11. The apparatus of claim 10 which also comprises a rotary drill bit attached to said tubing string, said drill bit comprising rotary cutters and a plurality of roller separately rotatable from said cutters.

12. The apparatus of claim 11 which also comprises a plurality of standoffs attached to said tubing string, said standoffs comprising rollers contacting said wellbore.

13. An apparatus for drilling a wellbore which comprises:

a tubular string rotatable around a string axis and extending from a first end to a second end;

a drill bit attached to said tubular string proximate to said second end;

a plurality of cutters attached to said drill bit, each of said cutters rotatable around cutter axes;

a plurality of rollers for contacting said wellbore attached to said drill bit between said cutters and said tubular string, each of said rollers separately rotatable around roller axes; and a plurality of standoffs attached to and covering a portion of said tubing string, said standoffs spaced apart from each other and comprising sleeved rollers contacting said wellbore and having a contact area at least 12 percent larger than said covered tubing string portion;

wherein said string axis, cutter axes, and roller axes are not co-linear with each other, wherein said rotatable cutters produce a first wellbore diameter and said rollers produce a second wellbore diameter generally larger than said first wellbore diameter by no more than about 0.635 cm when said apparatus is drilling said wellbore.

14. The apparatus of claim 13 wherein said standoff also comprises a pup joint attached between sections of said tubing string and wherein said pup joint comprises a fishing neck having a length of at least 20.32 cm.

15. A process for drilling an underground wellbore extending from a near surface location to an underground face comprising:

inserting a drill bit having a bit axis attached to a tubular string into said wellbore towards said underground face, wherein said drill bit comprises a plurality of separately rotatable cutting elements and a plurality of separately rotatable roller elements located between said cutters and said tubular string, each of said rotatable elements contactable with said wellbore;

rotating each of said cutting elements around cutter axes;

rotating each of said roller elements around roller axes; wherein each of said cutter axes are approximately orthogonal to said roller axes and said string axis and said roller axes are substantially parallel;

rotating said drill bit around said bit axis in the absence of rotation of a discoupled portion of said tubular string; and coupling rotation of said drill bit with rotation of the discoupled portion of said tubular string.

16. The process of claim 15 wherein said tubular string comprises telescoping joints and a pressure actuated discoupling device, said process which also comprises the steps of:

increasing fluid pressure within said tubular string sufficient to actuate said telescoping joints; and increasing fluid pressure within said tubular string sufficient to actuate said discoupling device.

17. The process of claim 16 which also comprises the steps of:

providing a flow of fluid from said tubular string towards said cutters; and providing a flow of fluid from said tubular string towards said rollers.

18. The process of claim 17 wherein said tubular string comprises an orienting subassembly and said process also comprises the step of reorienting said orienting subassembly.

19. The process of claim 17 wherein said tubular string comprises an umbilical line side entry subassembly and said process also comprises the steps of:

removing said drill bit; and introducing an umbilical line into said tubular string.

20. An apparatus for drilling a wellbore extending from near a surface location to an underground drilling face which comprises:

a tubular string extending from a first end near said surface location to a second end near said drilling face when said tubular string is inserted into said wellbore;

a rotary drill bit having a body attached to said tubing string proximate to said second end and having rotatable cutters separately rotatable from said drill bit body around a drill bit axis, said drill bit capable of removing materials from a drilling face when rotatably contacting said drilling face; and a plurality of rollers attached to the periphery of said drill bit and each rotatable around a roller axis substantially parallel to said drill bit axis, said rollers capable of rotating separately from said rotating cutters and bearing forces between said wellbore and said drill bit, wherein said forces are transmitted substantially perpendicular to said drill bit axis when said drill bit is rotating, wherein said separately rotatable cutters produce a cut wellbore diameter and said rollers compact said formation to increase said cut wellbore diameter to a larger compacted diameter by not more than about 0.635 cm larger when said apparatus is drilling said wellbore.

* * * * *